United States Patent [19]

Ullger

[11] 4,222,598

[45] Sep. 16, 1980

[54] CONTAINER

[75] Inventor: Edward J. Ullger, Babylon, N.Y.

[73] Assignee: Century Packaging Corp., Amityville, N.Y.

[21] Appl. No.: 950,942

[22] Filed: Oct. 12, 1978

[51] Int. Cl.[2] ..... A01K 29/00; B65D 5/08

[52] U.S. Cl. ..... 294/1 B; 229/39 R; 229/44 R

[58] Field of Search ..... 294/1 B, 1 BA, 1 BB, 294/55; 15/104.8, 257.1, 257.6, 257.9; 229/38, 39 R, 41 R, 41 B, 44 R, 45 R

[56] References Cited

U.S. PATENT DOCUMENTS

| | | | |
|---|---|---|---|
| 2,011,232 | 8/1935 | Parks et al. | 229/39 R |
| 2,403,047 | 7/1946 | Buttery | 229/44 R X |
| 3,830,423 | 8/1974 | Prescott | 294/1 B |
| 3,885,266 | 5/1975 | Nafziger | 229/41 B X |
| 3,971,503 | 7/1976 | Allan et al. | 294/1 B |
| 4,017,015 | 4/1977 | Jefferson | 294/55 X |

*Primary Examiner*—Johnny D. Cherry

*Attorney, Agent, or Firm*—Seidel, Gonda, Goldhammer & Panitch

[57] ABSTRACT

A container fabricated from a single blank of sheet material such as paperboard is cut, scored and folded, and assembled so that it may be shipped or stored in a collapsed condition. A scoop is provided integral with one of the side walls of the container.

10 Claims, 8 Drawing Figures

CONTAINER

SUMMARY OF THE INVENTION

The present invention is directed to a novel collapsible container having side walls connected to a bottom wall. A top wall is integral with a first side wall by way of a fold line. The top wall has a first panel generally perpendicular to said first side wall and a second panel generally parallel to a second side wall which is opposite said first side wall. The second side wall is longer than the first side wall by a distance corresponding generally to the length of said second panel. At least one blocking ear is provided on a third side wall for holding the top wall panels in said disposition.

It is an object of the present invention to provide a novel multi-purpose collapsible container.

It is a further object of the present invention to provide a collapsible container which may be used for retrieving animal excrement.

It is another object of the present invention to provide a collapsible container which can be made from a single sheet of paperboard and which is easily erected by the user and having positive locking means for retaining the container in a closed disposition.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
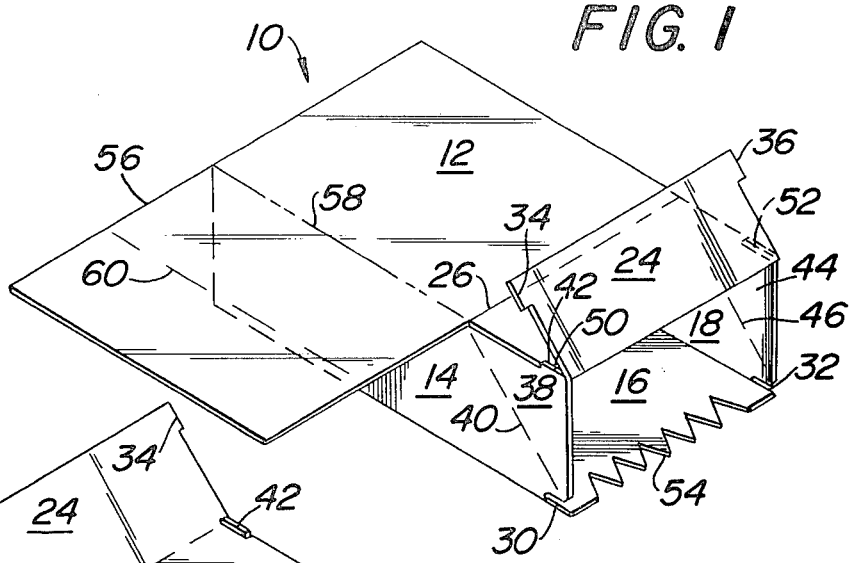
FIG. 1 is a perspective view of a container in accordance with the present invention and wherein the container is in an open disposition.
Figure 3:
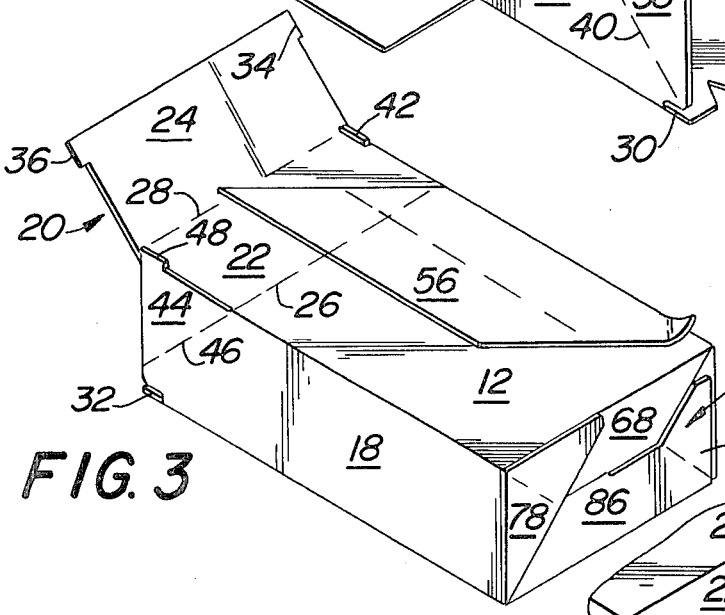
FIG. 3 is a perspective view similar to FIG. 1 but illustrating the container from a different angle.

Referring to the drawings in detail, wherein like numerals indicate like elements, there is shown in FIG. 1 a container in accordance with the present invention designated generally as 10. The container 10 has a plurality of interconnected side walls 12, 14, 16 and 18. Each side wall is connected to an adjacent side wall by a score line 17 so as to facilitate folding one side wall with respect to the next adjacent side wall.

The container 10 includes a bottom wall designated generally as 19 and which will be described in greater detail hereinafter. The container 10 also includes a top wall designated generally as 20. The top wall 20 is comprised of panels 22 and 24 interconnected by a score line or perforated line 28. Panel 22 is connected to the side wall 12 by a score line or perforation line 26. The side wall 16 is longer than the side wall 12 by a distance corresponding generally to the height of panel 22. See FIG. 2.

A slot 30 is provided at the intersection of side walls 14 and 16 at the upper end thereof. A slot 32 is provided at the intersection of side walls 16 and 18 at the upper end thereof. See FIG. 1. Panel 24 has tabs 34 and 36 on opposite ends thereof. When the container 10 is assembled, tab 34 will be disposed in slot 30 and tab 36 will be disposed in slot 32.

Side wall 14 is provided with an ear 38. Ear 38 is delineated by way of score line or perforation line 40 and is generally triangular in shape. Ear 38 has a tab 42 along one side edge thereof.

Side wall 18 has an ear 44 which is generally triangular in shape and delineated by way of fold line or perforation line 46. Ear 44 has a tab 48 along one side edge.

Panel 22 of the top wall 20 has a slot 50 along one side edge and a slot 52 along an opposite side edge. The slots 50, 52 are adjacent and extend from the line 28. See FIG. 2. Tab 48 is produced when slot 50 is cut.

If desired, the upper edge of side wall 16 may be provided with serrations 54. When the container 10 is used in connection with retrieval of animal excrement, it may be provided with an integral scoop 56. Scoop 56 is integral along one side edge with the side wall 12 and is delineated by the fold or perforation line 58. If desired, scoop 56 may be provided with a longitudinally extending score line 60 to facilitate bending the scoop 56. Scoop 56 is of a size generally corresponding to the size of side wall 12.

Figure 2:
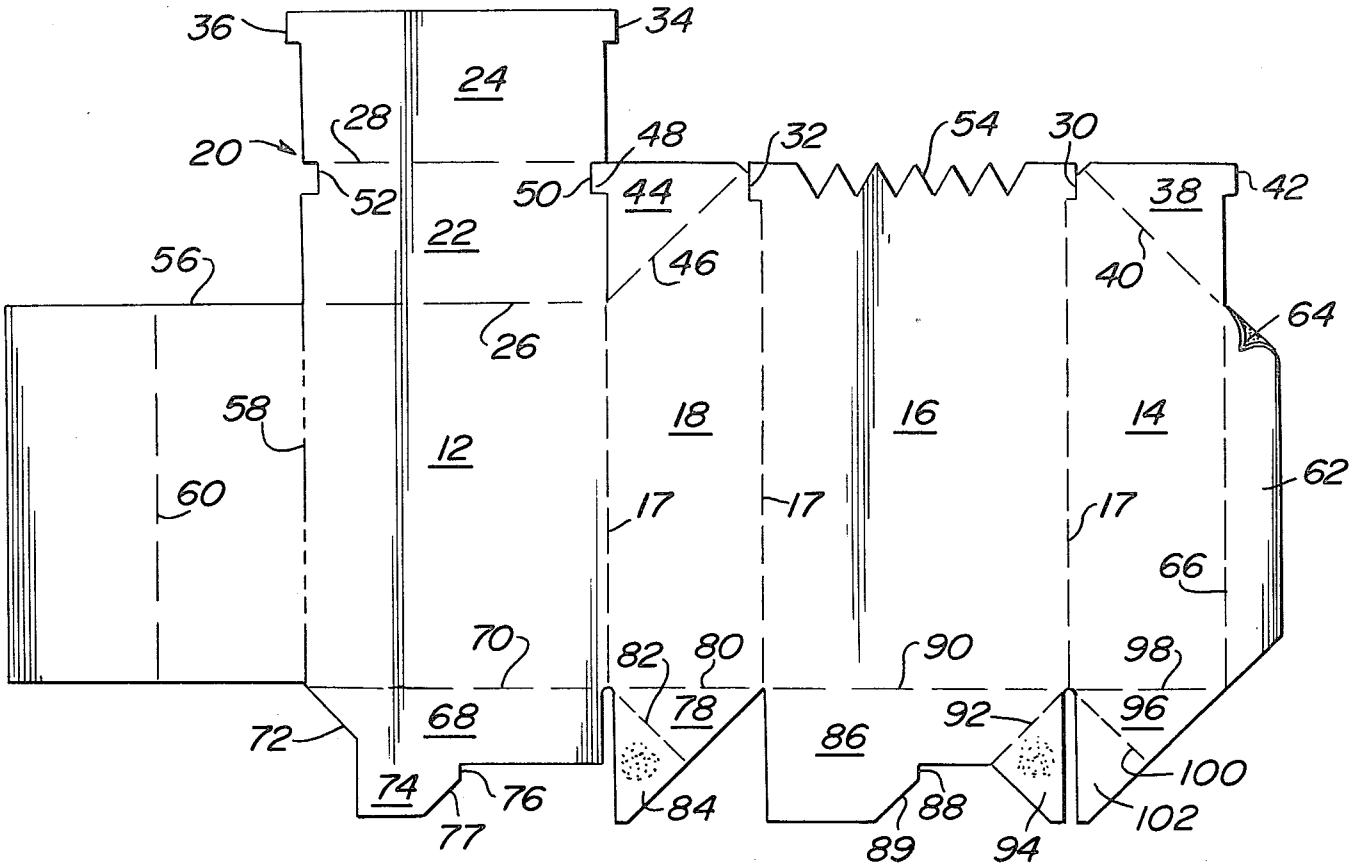
FIG. 2 is a plan view of a blank used in constructing the container shown in FIG. 1.

Referring to FIG. 2, there is illustrated a one piece blank in plan view and from which the container 10 is assembled. A tab 62 is provided integral with a side edge of side wall 14 and is delineated by way of the score line or perforation line 66. Adhesive 64 is provided on one surface of the tab 62. When assembling the container 10, the adhesive 64 on one face of the tab 62 will be bonded to an inner surface of side wall 12 along and adjacent to the line 58.

The bottom wall 19 of the container is comprised of four panels with each panel being integral with one of the side walls 12, 14, 16 and 18. Referring to the lower end of FIG. 2, a panel 68 is connected to the side wall 12 by a fold line or perforation line 70. Panel 68 has a tab 74, a locking portion 76, and an angled edge 77 extending from locking portion 76. Panel 68 has an angled edge 72. The angled edges 72, 77 are mutually perpendicular and are each at an angle of approximately 45° with respect to line 70.

A panel 78 is integral with the side wall 18 and is connected thereto by a fold line or perforation line 80. Panel 78 is generally a right triangle divided in half by way of a fold line or perforation line 82. Line 82 delineates one side edge of portion 84 having adhesive thereon. The adhesive on portion 84 is to be attached to the end of panel 68 remote from the angled edge 72.

The panel 86 is connected to side wall 16 by way of a fold line or perforation line 90. Panel 86 has a locking portion 88 and an angled edge 89 extending therefrom. Panel 86 has a portion 94 delineated along one side edge by the fold line or perforation line 92. Portion 94 has adhesive thereon and is adapted to overlie and join panel 86 to a panel 96.

A panel 96 is connected to side wall 14 by way of fold line or perforation line 98. Panel 96 is generally a right triangle and has a portion 102 delineated along one edge by way of the fold line or perforation line 100. Portions 94 and 102 are of the same size and are to be joined to one another.

Figure 6:
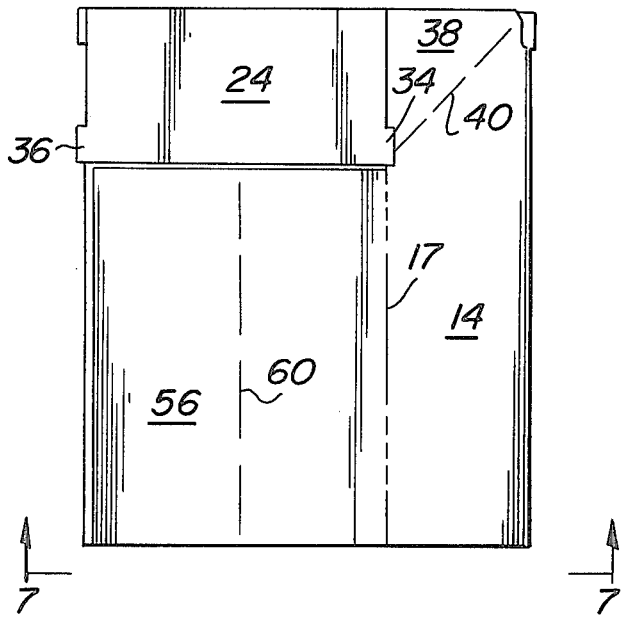
FIG. 6 is a plan view of a collapsed container in accordance with the present invention.
Figure 7:
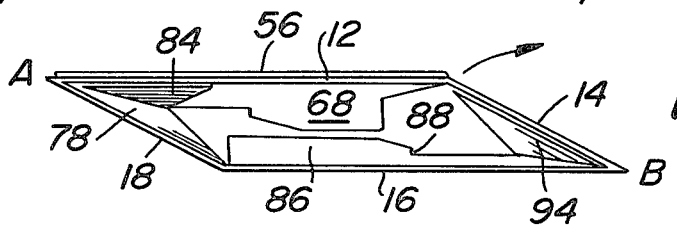
FIGS. 7 and 8 are end views of the container showing progressive erection of the container from the collapsed disposition.
Figure 8:
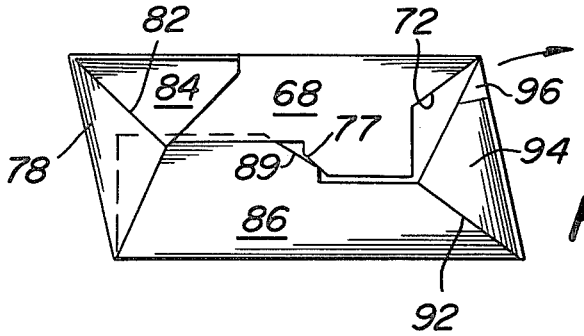

When assembling the blank as shown in FIG. 2 into a collapsed container as shown in FIG. 6, the adhesive on tab 62 is joined to the inner surface of side wall 12, the adhesive on portion 84 is joined to the adjacent portion of panel 68, and the adhesive on portion 94 is joined to portion 102. In order to erect the collapsed container from the disposition shown in FIG. 6 to the disposition shown in FIG. 1, it is only necessary to apply inwardly directed pressure at points A and B. See FIG. 7. Continued application of such pressure causes edges 77 and 89 to slide along one another until the locking portions 77 and 88 interlock.

The container 10 is now in condition for filling. When the container 10 is used for retrieving animal excrement, the scoop 56 is torn off along line 58. The container is held in the disposition shown in FIG. 1. The serrations 54 act as a rake. The excrement is scooped into the container 10 and thereafter the scoop 56 is also introduced into the container 10.

To close the container 10, the top wall 20 is pressed inwardly until panel 22 is generally perpendicular to the side wall 12 and side wall 16. Panel 24 will overlie side wall 16. Tab 34 will enter slot 30 and tab 36 will enter slot 32. When the tabs 34, 36 bottom out in their respective slots, panel 22 will be perpendicular to the side walls 12 and 16. As a result of the tabs 34, 36 and their related slots, panel 22 of the top wall 20 cannot be pushed into the container beyond its position perpendicular to the side walls 12 and 16.

Figure 4:
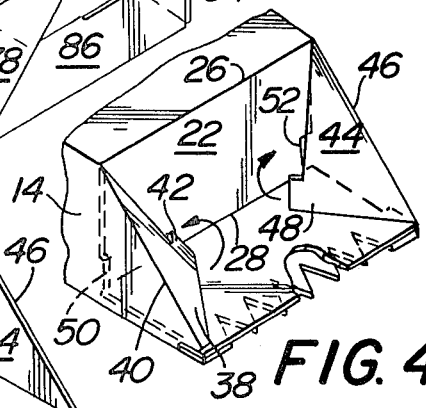
FIG. 4 is a partial perspective view of the top end of the container and in a partially closed disposition.
Figure 5:
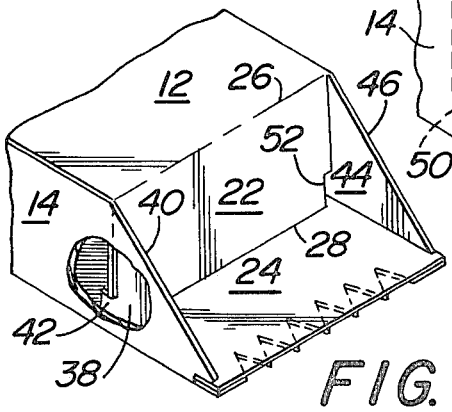
FIG. 5 is a view similar to FIG. 4 but showing the container top end in a closed disposition.

Thereafter, the ears 38 and 44 are bent inwardly as shown in FIG. 4. After tab 42 on ear 38 enters slot 50 and tab 48 on ear 44 enters slot 52, the container 10 is locked in a closed disposition whereby the top wall cannot accidentally pop open. Thereafter, the container 10 when used for retrieving animal excrement may be deposited in the nearest trash can.

The container of the present invention is characterized by the one piece construction which facilitates rapid manufacture at low cost and the easy to erect feature with respect to the bottom wall whereby no panels are required to be manipulated by the user. Further, there is a positive locking feature with respect to the top wall as described above and illustrated in the drawings.

The present invention may be embodied in other specific forms without departing from the spirit or essential attributes thereof and, accordingly, reference should be made to the appended claims, rather than to the foregoing specification, as indicating the scope of the invention.

I claim:

1. A collapsible container having side walls connected to a bottom wall, a top wall integral with a first side wall at a line which permits folding of the top wall with respect to said first side wall, the top wall having first and second panels pivotable with respect to one another, said first panel being generally perpendicular to said first side wall, said second panel being generally parallel to a second side wall opposite said first side wall, said second side wall being longer than said first side wall, at least one locking ear on a third side wall, said locking ear holding said top wall panels in a right angled disposition, a slot at the intersection of said second and third walls at the upper end thereof, said top wall second panel having a tab received within the last-mentioned slot.

2. A container in accordance with claim 1 including a scoop integral along one side edge and separable from one of said first and second side walls by a perforation line.

3. A container in accordance with claim 1 wherein said bottom wall is defined by a plurality of panels corresponding in number to the side walls, each bottom wall panel being integral with and connected to a side wall by way of a fold line, the panels attached to said first and second side walls having mating locking portions, said bottom wall panels being arranged to snap into a locked disposition when pressure is applied to opposite corners of the container in a collapsed condition.

4. A container in accordance with claim 1 wherein said top wall has a slot along a side edge of said top wall first panel, said locking ear having a tab received in the last-mentioned slot.

5. A container in accordance with claim 1 including a scoop integral with a side edge of one of said side walls and connected thereto by way of a perforation line to facilitate separation of the scoop, said scoop and said walls being made from a one piece blank.

6. A container comprising:

(a) first and second oppositely disposed side walls, third and fourth oppositely disposed side walls, said walls being connected together in a collapsed and in an erected position, panel means connected to a bottom end of each of said walls and defining a bottom wall which assumes a position generally perpendicular to said side walls as said walls are erected from a collapsed position, (b) first and second top wall panels connected together at a fold line, said first top wall panel being integral with said first side wall at the upper end thereof and connected thereto at a fold line, the combined height of said first side wall and said second top wall panel corresponding generally to the height of said second wall, (c) one of said top wall panels having a tab, one of said side walls having a slot for receiving said tab when said first top wall panel is generally perpendicular to each of said first and second side walls and said second top wall panel overlies the upper end of said second wall, (d) means for locking said first top wall panel in a position generally perpendicular to said first and second side walls, said locking means including at least one slot in said first top wall panel, said third wall having a tab, said third wall being foldable to a position wherein the tab thereon enters the slot in said first top wall panel.

7. A container in accordance with claim 6 wherein said locking means also includes a tab on the upper end of said fourth side wall, the upper end of said fourth side wall being foldable to a position wherein the tab thereon enters a different slot in said first top wall panel.

8. A container in accordance with claim 6 wherein said top wall panel having a tab is the second top wall panel and the slot therefor being at the intersection of said second and third walls at the upper end thereof.

9. A container in accordance with claim 6 including serrations at the upper edge of said second side wall.

10. A collapsible container having side walls connected to a bottom wall, a top wall integral with a first side wall at a line which permits folding of the top wall with respect to said first side wall, the top wall having first and second panels pivotable with respect to one another, said first panel being generally perpendicular to said first side wall, said second panel being generally parallel to said first side wall and overlying a portion of a second side wall opposite said first side wall, said second side wall being longer than said first side wall, said top wall first panel having a slot adjacent a side edge thereof, a locking ear pivotably connected to a third side wall, said locking ear having a portion disposed within said slot and having mutually perpendicular side edges contacting said top wall panels for holding said top wall panels in a right angled disposition.

* * * * *